US007734235B2

(12) United States Patent
Takehara et al.

(10) Patent No.: US 7,734,235 B2
(45) Date of Patent: Jun. 8, 2010

(54) IMAGE FORMING APPARATUS INCLUDING A METALLIC DRIVING ROLLER

(75) Inventors: Atsushi Takehara, Tokyo (JP); Akihiro Kawasaki, Tokyo (JP); Yoshie Iwakura, Tokyo (JP); Tomoya Adachi, Tokyo (JP); Takafumi Miyazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 11/276,666

(22) Filed: Mar. 9, 2006

(65) Prior Publication Data

US 2006/0210326 A1 Sep. 21, 2006

(30) Foreign Application Priority Data

Mar. 18, 2005 (JP) ..... 2005-080712

(51) Int. Cl.
*G03G 15/01* (2006.01)

(52) U.S. Cl. ..... 399/302; 399/300; 399/308

(58) Field of Classification Search ..... 399/300, 399/302, 308

See application file for complete search history.

(56) References Cited

U.S. PATENT DOCUMENTS

| | | | | |
|---|---|---|---|---|
| 6,249,304 | B1 | 6/2001 | Sawayama et al. | |
| 6,292,206 | B1 | 9/2001 | Takehara et al. | |
| 6,295,438 | B1 | 9/2001 | Fujishiro et al. | |
| 6,334,039 | B1 | 12/2001 | Yoshinaga et al. | |
| 6,366,754 | B1 | 4/2002 | Sato et al. | |
| 6,408,155 | B1 * | 6/2002 | Tajima et al. | 399/302 |
| 6,782,227 | B2 | 8/2004 | Ishibashi et al. | |
| 6,850,726 | B1 * | 2/2005 | Mizuno et al. | 399/302 |
| 7,003,238 | B2 | 2/2006 | Yoshida et al. | |
| 7,164,877 | B2 * | 1/2007 | Murakami et al. | 399/299 |
| 2003/0147677 | A1 | 8/2003 | Kim | |
| 2004/0109709 | A1 | 6/2004 | Ishibashi et al. | |
| 2004/0228642 | A1 * | 11/2004 | Iida et al. | 399/27 |
| 2005/0013636 | A1 | 1/2005 | Sawai et al. | |
| 2005/0058924 | A1 * | 3/2005 | Miyakawa | 430/108.6 |
| 2005/0147424 | A1 | 7/2005 | Kato et al. | |
| 2005/0226651 | A1 | 10/2005 | Umezawa et al. | |
| 2006/0083557 | A1 * | 4/2006 | Nakano et al. | 399/302 |

(Continued)

FOREIGN PATENT DOCUMENTS

CN 1470950 A 1/2004

(Continued)

OTHER PUBLICATIONS

Abstract of JP2001027850A to Moriya et al.*

(Continued)

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

In an image forming apparatus, an intermediate transfer belt is made of a resin film and is supported by a plurality of rollers. A driving roller that is one of the plurality of rollers, drives the intermediate transfer belt, and also functions as an opposing unit with respect to a secondary transfer roller. The driving roller is made of metal, and applies a bias to at least secondary transfer units, at least at a time of performing primary transfer to a plurality of image bearing bodies.

11 Claims, 5 Drawing Sheets

U.S. PATENT DOCUMENTS

2006/0210324 A1 * 9/2006 Kuma et al. ..... 399/301

FOREIGN PATENT DOCUMENTS

JP 6-138742 5/1994
JP 8-152812 6/1996
JP 9-292777 11/1997
JP 10-268656 10/1998
JP 2001027850 A * 1/2001
WO WO 03/003127 A1 1/2003

OTHER PUBLICATIONS

U.S. Appl. No. 11/855,739, filed Sep. 14, 2007, Fuwa, et al.
U.S. Appl. No. 12/135,490, filed Jun. 9, 2008, Miyazaki, et al.

* cited by examiner

IMAGE FORMING APPARATUS INCLUDING A METALLIC DRIVING ROLLER

CROSS-REFERENCE TO RELATED APPLICATIONS

The present document incorporates by reference the entire contents of Japanese priority document, 2005-080712 filed in Japan on Mar. 18, 2005.

BACKGROUND OF THE INVENTION

1. Field of the Invention

The present invention relates to an image forming apparatus such as a copying machine, a printer, a facsimile etc. that includes an intermediate transferring body and that uses an intermediate transfer method.

2. Description of the Related Art

An intermediate transfer method is one of the widely used conventional methods for color image formation. In the intermediate transfer method, toner images of different colors that are formed on a plurality of photosensitive drums are overlapped and transferred to an intermediate transferring body, and then the toner images are collectively transferred to a transfer sheet. Because the photosensitive drums are serially provided opposite the transfer sheet or the intermediate transferring body, the intermediate transfer method is also called a tandem method. In the intermediate transfer method, an electronic copying process is executed and includes formation of electrostatic latent image, printing etc. pertaining to yellow (Y), magenta (M), cyan (C), and black (B) colors in each photosensitive drum, and the resulting electrostatic latent images are transferred to a moving intermediate transferring body.

Japanese Patent Laid-Open Publication No. H8-152812 discloses a technology to prevent a slip between an intermediate transfer belt and a driving roller, in which the driving roller is made of a material of μ thickness such as rubber or a rubber coating, to overcome the aforementioned drawback. Japanese Patent Laid-Open Publication No. H10-268656 discloses a technology in which, an average friction coefficient pertaining to the contact surfaces of the driving roller and the intermediate transfer belt is maintained between 0.1 and 0.45, and a cleaning blade is disjunctively provided as a backup to the driving roller until a primary transfer of the last toner image is complete.

However, the aforementioned intermediate transfer method has the following drawbacks. Image formation by using the technology to overlap colors is extremely difficult. Especially occurrence of a slip between the intermediate transfer belt and the driving roller during a primary transfer results in a significant deviation in positions of each color, thereby resulting in a color drift.

In the technology disclosed in Japanese Patent Laid-Open Publication No. H8-152812, the driving roller made of a material of μ thickness such as rubber or a rubber coating is used to prevent the color drift, necessitating a technology to include the rubber coating on a metal shaft of the driving roller, thereby increasing the cost.

An image forming apparatus disclosed in Japanese Patent Laid-Open Publication No. H10-268656 uses a metal roller as the driving roller, and it is mentioned that "Occurrence of a slip between a driving shaft and the intermediate transfer belt is acceptable". In other words, the technology emphasizes on avoiding the influence of shock during contact of the cleaning blade, but does not consider preventing occurrence of a slip between the driving shaft and the intermediate transfer belt.

Moreover, when including sensors for detecting patterns on the intermediate transfer belt, supporting the intermediate transfer belt with two spindles restricts the fixing positions of the sensors. In other words, a technology is needed which prevents occurrence of a slip between the intermediate transfer belt and the driving roller even if a cheap metal roller is used as the driving roller.

SUMMARY OF THE INVENTION

It is an object of the present invention to at least solve the problems in the conventional technology.

According to an aspect of the present invention, an image forming apparatus includes a plurality of image bearing bodies; a secondary transfer roller; an intermediate transfer belt made of a resin film and supported by a plurality of rollers; a driving roller that is one of the plurality of rollers, drives the intermediate transfer belt, and that also functions as an opposing unit with respect to the secondary transfer roller; where the driving roller is made of metal, and applies a bias to at least secondary transfer units, at least at a time of performing primary transfer to the image bearing bodies.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below, with reference to the accompanying drawings. Although specific names of components are used to simplify comprehension of the present invention, the present invention is not to be thus limited.

Figure 1:
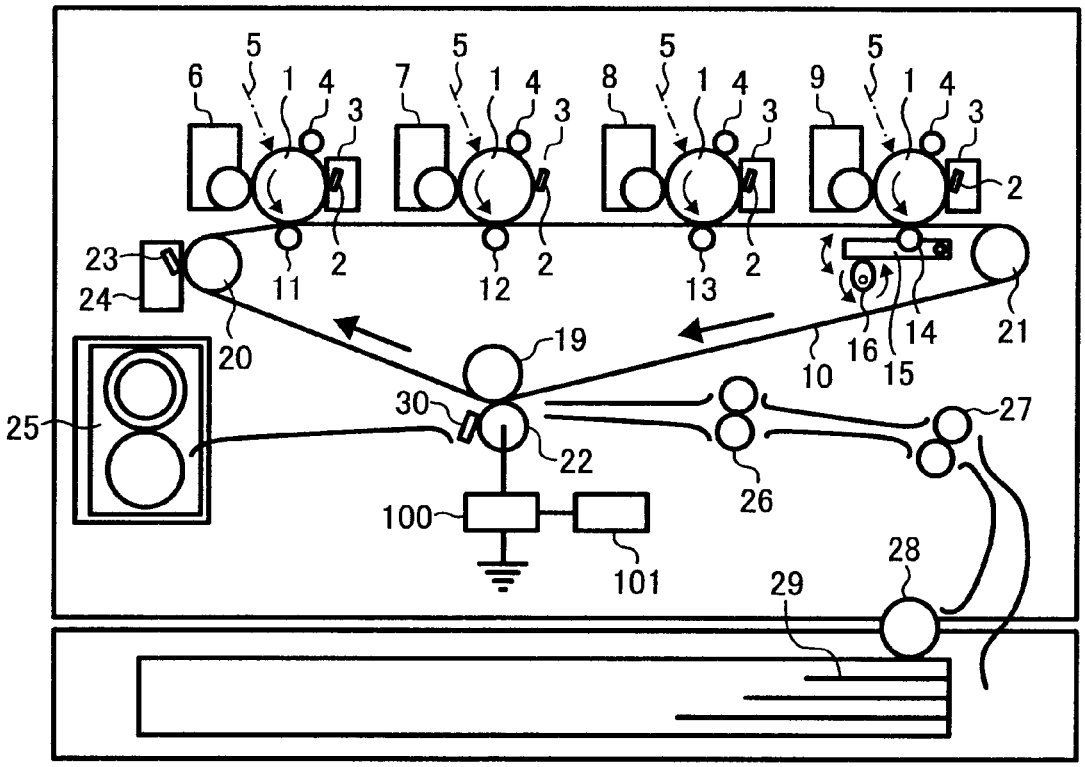
FIG. 1 is an outline of a conventional image forming apparatus.

FIG. 1 is a drawing of a conventional color image forming apparatus that uses an intermediate transfer belt as an intermediate transfer body. Cylindrical photosensitive drums 1 rotate in the direction indicated by the arrow with a peripheral velocity of 150 millimeter per second (mm/s). Roller shaped chargers 4, which serve as charging units, are pressed against the surface of the photosensitive drums 1. The chargers 4 rotate along with the photosensitive drums 1. The chargers 4 are uniformly charged with a surface potential of −500V by a high voltage power supply (not shown) that applies an Alternate Current (AC) and Direct Current (DC) bias. Exposing units 5, which serve as latent image forming units, expose image data to form electrostatic latent images on the photosensitive drums 1. A laser beam scanner or a Light Emitting Diode (LED) that uses a laser diode carries out the exposing process.

Photosensitive drum cleaning units 3 clean residual toner on the surface of the photosensitive drums 1. The photosensitive drum cleaning units 3 include blades 2. A developing unit in the present embodiment is of one component contact developing type, and includes a yellow developing unit 6, a cyan developing unit 7, a magenta developing unit 8, and a black developing unit 9. The yellow developing unit 6, the cyan developing unit 7, the magenta developing unit 8, and the black developing unit 9 use a predetermined developing bias that is supplied by the high voltage power supply (not shown), and convert the electrostatic latent images on the surface of the photosensitive drums 1 into visual images such as toner images.

The four photosensitive drums 1 are serially arranged. During formation of a full color image, the visual images are formed in the sequence of a yellow visual image, a cyan visual image, a magenta visual image, and a black visual image. Each of the aforementioned visual images are sequentially overlapped and transferred to an intermediate transfer belt 10 to form the full color visual image. A driving roller 21, primary transfer bias rollers 11 through 14, a secondary transfer opposing roller 19, and a belt cleaning opposing roller 20 support the intermediate transfer belt 10. A driving motor (not shown) rotatably drives the intermediate transfer belt 10 in the direction indicated by the arrow. The primary transfer bias roller 14 is held by a primary transfer bias roller retaining unit 15, and is pressed in the direction of the photosensitive drums 1 by a detachable cam 16.

In normal condition, the detachable cam 16 presses the primary transfer bias roller 14 in the direction of the photosensitive drums 1. The detachable cam 16 rotates only when the photosensitive drums 1 or the intermediate transfer belt 10 are detached, and separates the primary transfer bias roller 14 from the photosensitive drums 1. Polyurethane rubber of thickness between 0.3 millimeters (mm) and 1 mm is used as material for the driving roller 21.

The primary transfer bias rollers 11 through 14 are explained later. A blade 23 of a belt cleaning unit 24 scrapes the residual toner from the intermediate transfer belt 10, thereby cleaning the intermediate transfer belt 10. Each roller that supports the intermediate transfer belt 10 is supported on both the sides of the intermediate transfer belt 10 by intermediate transfer belt unit side plates (not shown).

Material for the intermediate transfer belt 10 can be manufactured by dispersing conductive material such as carbon black on PolyVinylidine DiFluoride (PVDF), Ethylene TetraFluoroEthylene (ETFE), Polyimide (PI), Polycarbonate (PC), Thermo Plastic Elastomer (TPE) etc. to form an endless belt in the form of a resin film. The intermediate transfer belt 10 used in the present embodiment is a single layer belt formed by treating PC with carbon black, and has a thickness of 140 mm.

In a resistance measurement method pertaining to the intermediate transfer belt 10, a probe (having inner electrode diameter of 50 mm, ring electrode diameter of 60 mm, and conforming to the JIS-K6911 standard) is connected to a digital high resistance micro ammeter (model R8340A manufactured by Advantest), and a voltage of 1000V (surface resistivity of 500V) is applied to both the surfaces of the intermediate transfer belt 10 to measure the resistance by discharging for 5 seconds and charging for 10 seconds. The environment during measurement of the resistance is fixed at a temperature of 22° C. and a Relative Humidity (RH) of 55 percent. A volume resistivity between $10^8$ ohm-centimeter (Ωcm) and $10^{12}$ Ωcm, and a surface resistivity between $10^9$ ohm (Ω) and $10^{12}$ Ω per square pertaining to the intermediate transfer belt 10 is desirable.

If the volume resistivity and the surface resistivity of the intermediate transfer belt 10 exceed the aforementioned range, then for charging the intermediate transfer belt 10, potential levels that are set need to be successively increased in the image forming sequence, thereby making it difficult to supply power to a primary transfer unit using a single electrical power source. This is because charge potential on the surface of the intermediate transfer belt 10 increases due to occurrence of discharge during a transfer process or a transfer sheet separation process, and self discharging becomes difficult, thereby necessitating inclusion of a neutralizing unit for the intermediate transfer belt 10. If the volume resistivity and the surface resistivity of the intermediate transfer belt 10 fall below the aforementioned range, although acceleration of potential decay enhances neutralization due to self discharging, during transfer the current flows in the direction of the surface, thereby resulting in occurrence of spattering of toner. Thus, the volume resistivity and the surface resistivity of the intermediate transfer belt 10 according to the present embodiment must be within the aforementioned range.

A secondary transfer bias roller 22 is also included. The secondary transfer bias roller 22 is manufactured by plating a metal shaft made of SUS etc. with a urethane elastomer having a resistance between $10^6$ and $10^{10}$ Ω that is controlled by a conductive material. If the resistance of the secondary transfer bias roller 22 exceeds the aforementioned range, flow of the current is hampered, and higher potential needs to be applied to get the necessary transferability, thereby increasing the power cost.

The necessity to apply higher potential causes discharging in the gap around transfer unit nip, thereby resulting in occurrence of white spots on a halftone image. Such a phenomenon is especially observed in an environment having low temperature and low humidity (for example, a temperature of 10° C. and a Relative Humidity (RH) of 15 percent).

If the resistance of the secondary transfer bias roller 22 falls below the aforementioned range, a multicolored image portion (for example, an image formed by overlapping of three colors) and monochromatic image portions that exist in the same image become mutually incompatible. Because the resistance of the secondary transfer bias roller 22 is low, although flow of the current is sufficient to transfer the monochromatic image portions at comparatively low potential, a higher potential is necessary for transferring the multicolored image portion than the potential that is optimum for the monochromatic image portions. Setting the potential at a level that enables transfer of the multicolored image portion results in excess of transfer current in the monochromatic image portions, thereby reducing the transfer efficiency.

To measure the resistance of the secondary transfer bias roller 22, the secondary transfer bias roller 22 is positioned on a conductive metallic plate, weights of 4.0N (a total of 9.8N at both the ends) are suspended from each end of a shaft, a potential of 1000V is applied between the shaft and the metal plate, and the resistance is measured from the resulting current. The resistance pertaining to the secondary transfer bias roller 22 is also measured by fixing the environment to a temperature of 22° C. and an RH of 55 percent. In the present embodiment, the resistance of the secondary transfer bias roller 22 is controlled such that the resistance, when measured by the aforementioned method, is 7.8 Log Ω.

A structure of the primary transfer bias rollers 11 through 14 is similar to the structure of the secondary transfer bias roller 22. Because the primary transfer bias rollers 11 through 14 touch the photosensitive drums 1 via the intermediate transfer belt 10, an appropriate elastic layer needs to be included in the primary transfer bias rollers 11 through 14 to secure a primary transfer nip. Although the range of resistance pertaining to an intermediate transfer belt layer is not as severe as the range of resistance pertaining to the secondary transfer bias roller 22, in the present embodiment, the resistance of the primary transfer bias rollers 11 through 14 is controlled such that the resistance, when measured using the aforementioned method, is 7.0 Log Ω.

A pickup roller 28, a paper feed roller 27, and a resist roller 26 feed transfer sheets 29 at a time when the apical portion of the toner image on the surface of the intermediate transfer belt 10 reaches a secondary transfer position. A toner image on the intermediate transfer belt 10 is transferred to the transfer sheets 29 by a predetermined transfer bias that is applied by a high voltage power supply 100. The transfer sheets 29 are separated from the intermediate transfer belt 10 due to curvature pertaining to the secondary transfer opposing roller 19 and a predetermined separation bias that is applied by a separating unit 30. A fixing unit 25 fixes the toner image that is transferred to the transfer sheets 29 and the transfer sheets 29 are ejected.

Four modes are included in the present embodiment. A monochromatic image pertaining to any one of yellow, magenta, cyan, and black colors is formed in a monochromatic mode. Overlapping of images pertaining to any two of yellow, magenta, cyan, and black colors forms a dichromatic image in a dichromatic mode. Overlapping of images pertaining to any three of yellow, magenta, cyan, and black colors forms a trichromatic image in a trichromatic mode. Overlapping of images pertaining to all the four of the aforementioned colors forms an image in a full color mode. The aforementioned four modes can be specified using an operating unit.

In the present embodiment, a process speed during fixing can be modified according to the type of the transfer sheets 29. To be specific, when using transfer sheets having a ream weight of more than 110 kilograms (kg), the process speed is reduced to half the normal process speed, and the time required for the transfer sheets to pass a fixing nip that is formed due to a fixing roller is double the time required during the normal process speed, thereby securing fixability of the toner image.

Figure 2:
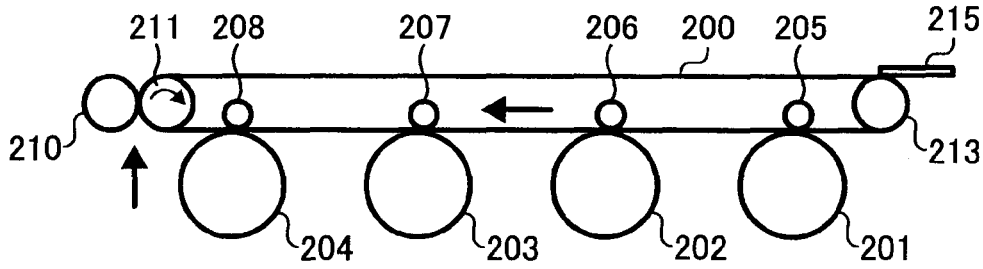
FIG. 2 is an outline of an intermediate transferring body and a driving roller according to an embodiment of the present invention.

Components that differ from the aforementioned image forming apparatus are explained next with reference to FIG. 2 through FIG. 4. FIG. 2 is a schematic of an intermediate transferring body and a driving roller. An image forming unit includes four photosensitive drums 201 through 204. A driving roller 211, a supporting roller 212, and a tension roller 213 support an intermediate transfer belt 200. The driving roller 211 also functions as an opposing roller pertaining to a secondary transfer roller 210.

An SUS metal roller having a ten point average roughness Rz between 0.03 μm and 0.1 μm is used as the driving roller 211. Due to this, a predetermined potential is applied in the direction of motion of the intermediate transfer belt 200 from a primary transfer roller 208 to a primary transfer roller 205, thereby overlapping images of each of the aforementioned four colors on the intermediate transfer belt 200. By applying predetermined potential, the image pertaining to the last color is overlapped to form a color image. By applying predetermined potential to the secondary transfer roller 210, the color image thus formed is transferred to sheets 214 that serve as transfer sheets. Next, the color image is fixed by a fixing unit (not shown) and ejected. A cleaner blade unit 215 collects the residual toner that cannot be transferred by the secondary transfer roller 210 and that is remaining on the intermediate transfer belt 200.

In other words, if metal is used as a material for the driving roller 211, expansion due to heat is less as compared to a driving roller made of rubber or a coating, and there is less variation in the surface speed of the driving roller due to temperature, besides being cost effective. However, allowance for sliding (slip) between the driving roller 211 and the intermediate transfer belt 200 is less due to weaker grip of the metal roller.

To overcome this drawback, in the embodiment shown in FIG. 2, the metal roller, which is used as the driving roller 211, also serves as a secondary transfer opposing roller that necessitates application of a bias. By applying a bias to secondary transfer units, the driving roller 211 is also electrostatically adsorbed, thereby enhancing the allowance for slip. Thus, during a primary transfer that is mainly responsible for color drift, by applying at least a bias pertaining to the secondary transfer units enables to stably use the metal roller as the driving roller 211, thereby enabling to provide an image forming apparatus that is cost effective and that reduces the color drift.

Figure 3:
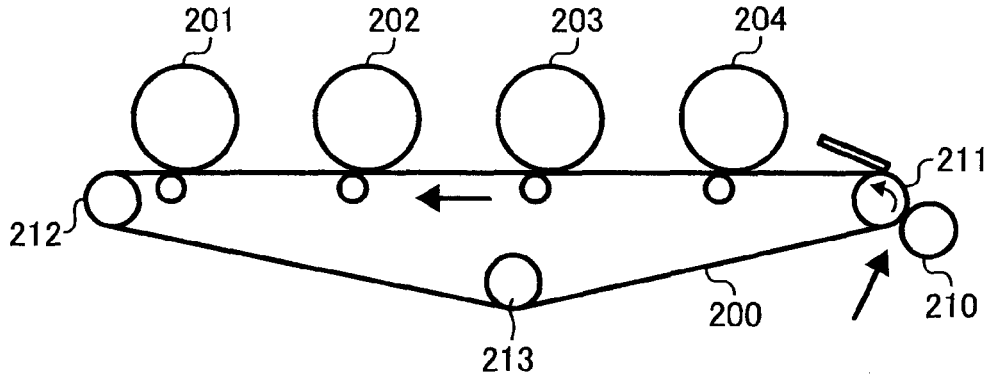
FIG. 3 is another outline of the intermediate transferring body and the driving roller.

FIG. 3 is a schematic of the intermediate transferring body and the driving roller. As shown in FIG. 3, positioning of the driving roller 211 on the anterior side of the photosensitive drums 201 through 204 is the salient feature of the embodiment. Positioning the driving roller 211 on the anterior side of the photosensitive drums 201 through 204 enables to secure a distance between the photosensitive drum 201 that is positioned on the extreme posterior side and the secondary transfer roller 210, thereby enabling to include sensors without increasing the size of the image forming apparatus. The sensors read a pattern on the intermediate transfer belt 200. Thus, an image forming apparatus can be provided that is cost effective, reduces the color drift, and enables a greater allowance for positioning of sensors on the intermediate transfer belt.

Figure 4:
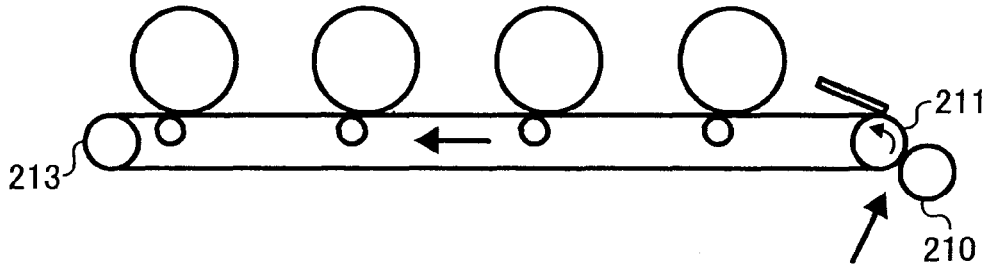
FIG. 4 is still another outline of the intermediate transferring body and the driving roller.

FIG. 4 is a schematic of the intermediate transferring body and the driving roller. As shown in FIG. 4, the driving roller 21 and the tension roller 213 support the intermediate transfer belt 200, and a winding angle of the intermediate transfer belt 200 towards the driving roller 211 and the tension roller 213 is equal to or more than 170°.

Supporting the intermediate transfer belt 200 by using the spindles of the driving roller 211 and the tension roller 213 enables to restrict to a minimum, the number of rollers that support the intermediate transfer belt 200. Further, ensuring that the winding angle towards the driving roller 211 and the intermediate transfer belt 200 is equal to or more than 170° enables to reduce the slip between the driving roller 211 and the intermediate transfer belt 200 even if the metal roller is used.

Figure 5A:
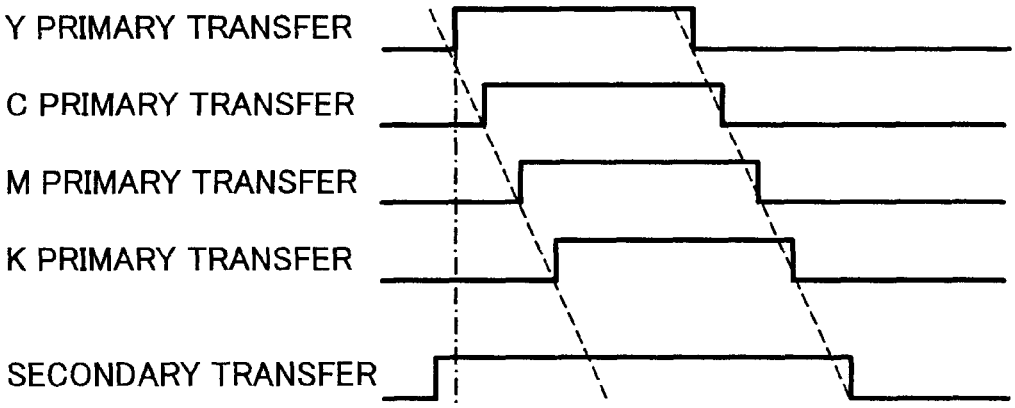
FIG. 5A and FIG. 5B are schematics pertaining to application timing of a primary transfer bias and a secondary transfer bias.
Figure 5B:
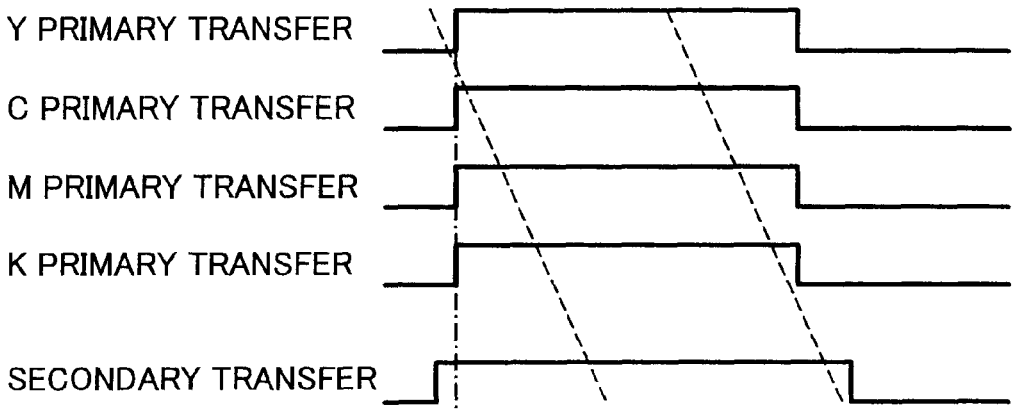

FIG. 5A and FIG. 5B are schematics pertaining to application timing of a primary transfer bias and a secondary transfer bias. As shown in FIG. 5, the secondary transfer bias is always applied during application of the primary transfer bias, thereby enabling to reduce the color drift in the primary transfer units due to a slip between the driving roller 211 and the intermediate transfer belt 200.

Figure 6:
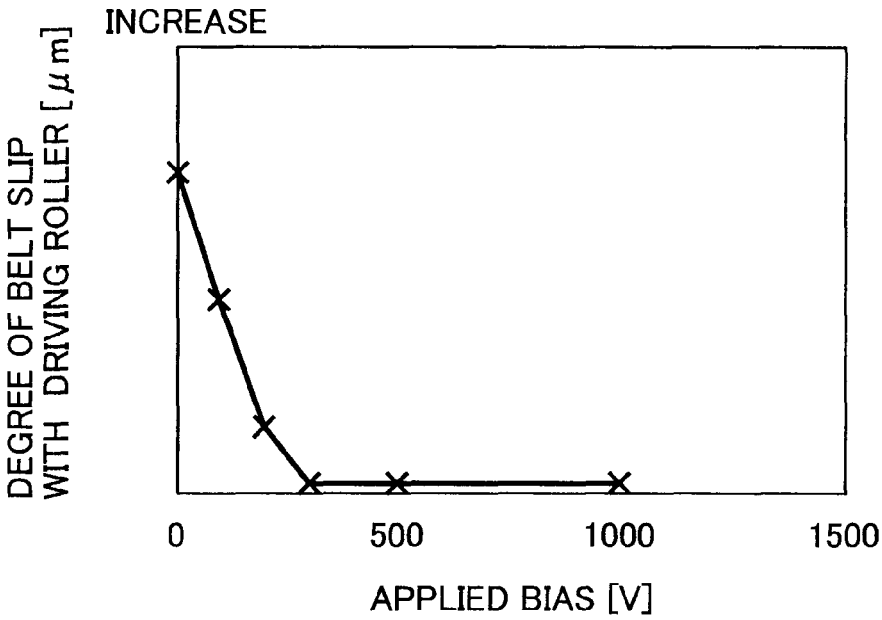
FIG. 6 is a schematic of a relation between bias applied to the driving roller and a degree of slip with an intermediate transfer belt.

FIG. 6 is a schematic of a relation between bias applied to the driving roller 211 and a degree of slip with the intermediate transfer belt 200. As shown in FIG. 6, increasing the applied bias pertaining to the driving roller 211 enhances the degree of slip allowance.

Figure 7:
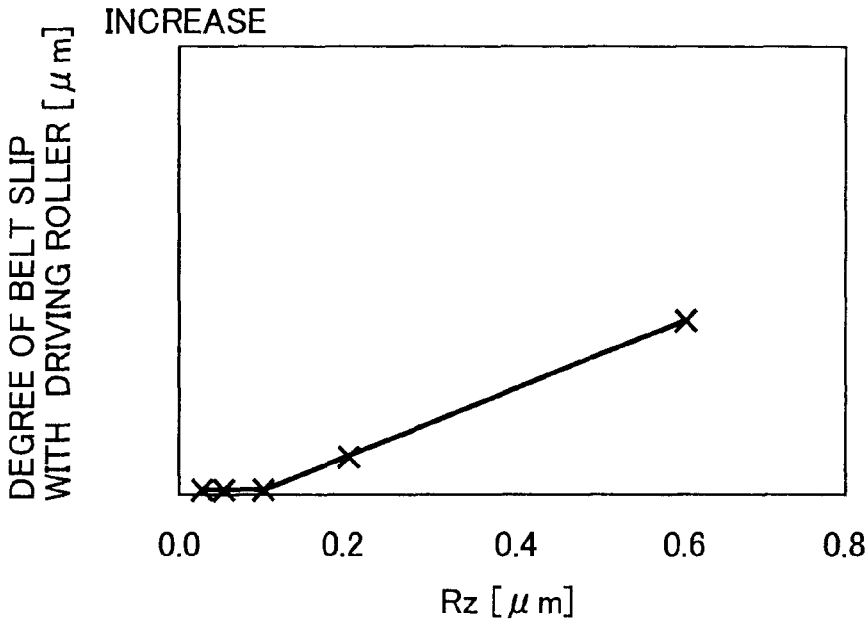
FIG. 7 is a schematic of a relation between ten point average roughness Rz pertaining to the driving roller and the degree of slip allowance with the intermediate transfer belt.

FIG. 7 is a schematic of a relation between ten point average roughness Rz pertaining to the driving roller 211 and the degree of slip allowance with the intermediate transfer belt 200 when a metal roller is used as the driving roller 211. As shown in FIG. 7, ten point average roughness Rz pertaining to the metal roller that is used as the driving roller 211 is greater than 0.03 and less than 0.1. By setting the ten point average roughness Rz within the aforementioned range enables to enhance the coherence pertaining to the metal roller and the intermediate transfer belt 200, thereby enabling to effectively curb the slip between the intermediate transfer belt 200 and the driving roller 211 even if the metal roller is used as the driving roller 211.

Figure 8:
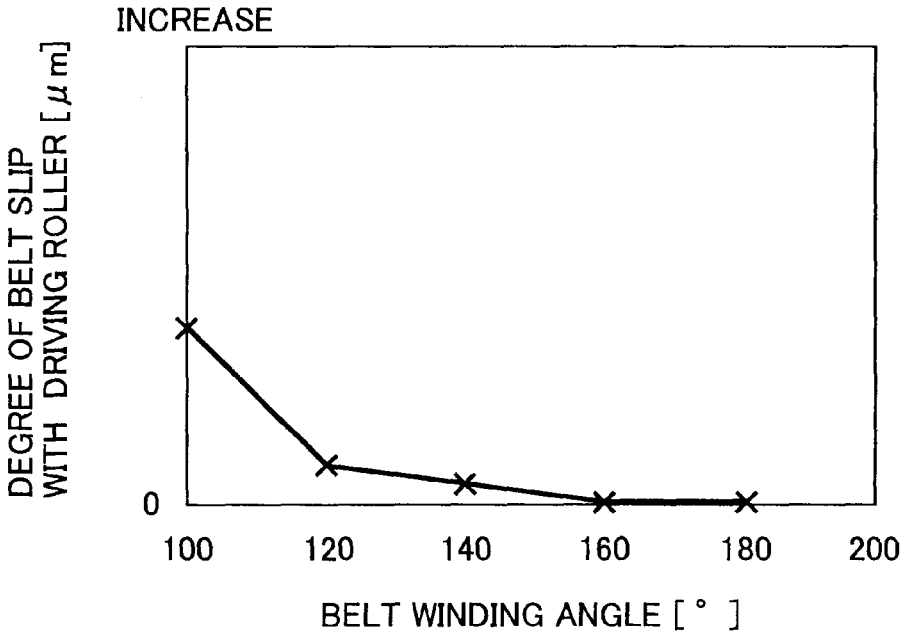
FIG. 8 is a schematic of a relation between a belt winding angle and the degree of slip allowance pertaining to the intermediate transfer belt.

FIG. 8 is a schematic of a relation between a belt winding angle and the degree of slip allowance pertaining to the intermediate transfer belt 200 when the metal roller having ten point average roughness Rz less than 0.1 μm is used as the driving roller 211. As shown in FIG. 8, the degree of belt slip is minimum in the portion in which the belt winding angle is equal to or more than 170°.

Figure 9:
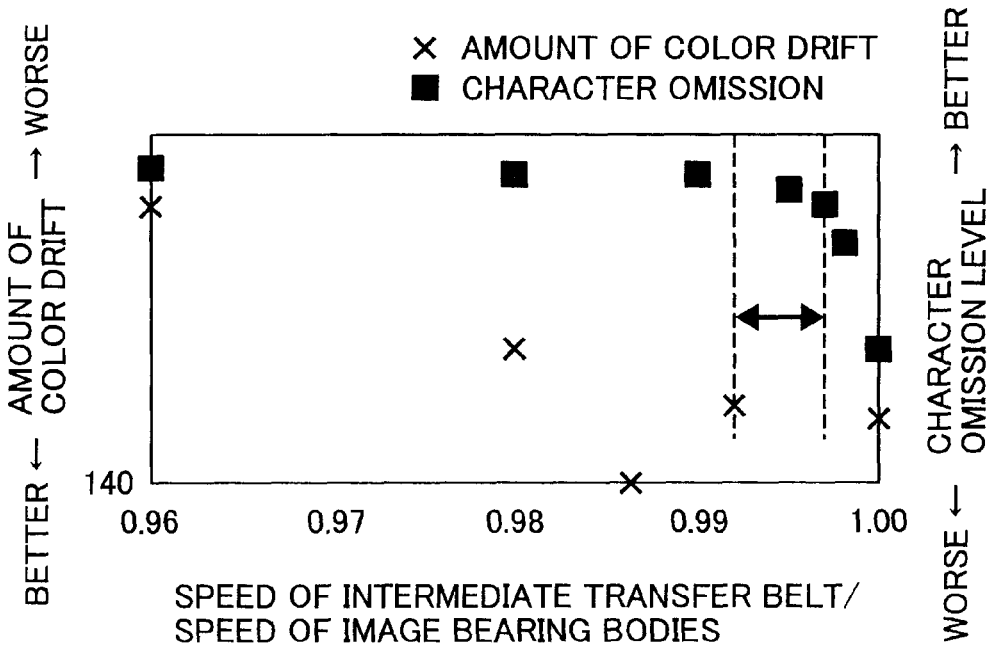
FIG. 9 is a schematic of a relation between character omission and color drift.

FIG. 9 is a schematic of a relation between character omission and color drift. As shown in FIG. 9, the amount of character omission and the color drift is the least in the portion in which a speed ratio pertaining to the photosensitive drums 201 through 204 and the intermediate transfer belt 200 (represented by a speed of the intermediate transfer belt 200 divided by a surface speed of the photosensitive drums 201 through 204) is equal to or more than 0.992 and less than 0.997. The photosensitive drums 201 through 204 rotate with a greater speed than the speed of the intermediate transfer belt 200, thereby enabling to provide an image forming apparatus that reduces the number of defective images having character omissions.

According to the present invention, an image forming apparatus can be provided that is cost effective, reduces the color drift, and enables a greater allowance for positioning of sensors on an intermediate transfer belt.

Moreover, a slip between a driving roller and the intermediate transfer belt can be reduced even if a metal roller is used, thereby further controlling cost.

Moreover, the number of defective images with character omissions reduces.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a plurality of image bearing bodies;

a secondary transfer roller;

an intermediate transfer belt made of a resin film and supported by a plurality of rollers; and a driving roller that is one of the plurality of rollers, drives the intermediate transfer belt, and that forms a roller pair with the secondary transfer roller, wherein the driving roller is made of metal, and the driving roller applies a bias to at least the secondary transfer roller at least at a time that a primary transfer of an image via the image bearing bodies is performed.

2. The image forming apparatus according to claim 1, wherein the driving roller is positioned on an upstream side of the image bearing bodies with respect to a rotation direction of the intermediate transfer belt.

3. The image forming apparatus according to claim 1, further comprising:

a tension roller that applies tension to the intermediate transfer belt, wherein the intermediate transfer belt is supported by and rotates around the driving roller and the tension roller, and a winding angle of the intermediate transfer belt towards the driving roller and the tension roller is equal to or more than 170°.

4. The image forming apparatus according to claim 1, wherein a ten point average roughness Rz for the driving roller is more than 0.03 μm and less than 0.1 μm.

5. The image forming apparatus according to claim 2, wherein speed of rotation of the image bearing bodies is more than that of the intermediate transfer belt.

6. The image forming apparatus according to claim 2, wherein a speed ratio of the image bearing bodies and the intermediate transfer belt is equal to or more than 0.992 and less than 0.997.

7. The image forming apparatus according to claim 1, wherein the intermediate transfer belt has a volume resistivity of between $10^8$ Ω·cm and $10^{12}$ Ω·cm.

8. The image forming apparatus according to claim 1, wherein the secondary transfer roller has a resistance between $10^6$ Ω and $10^{10}$ Ω.

9. The image forming apparatus according to claim 1, wherein the driving roller applies the bias to at least the secondary transfer roller from a start of the primary transfer of the image via the image bearing bodies until after the primary transfer is completed.

10. The image forming apparatus according to claim 1, wherein the driving roller applies the bias to at least the secondary transfer roller from before a start of the primary transfer of the image via the image bearing bodies until after the primary transfer is completed.

11. The image forming apparatus according to claim 1, wherein the plurality of image bearing bodies includes four image bearing bodies, and the driving roller applies the bias to at least the secondary transfer roller from a start of the primary transfer of the image from a first one of the image bearing bodies in a direction of transfer until after the primary transfer from a last one of the image bearing bodies in the direction of transfer is completed.

* * * * *